United States Patent [19]

Venkatesan

[11] Patent Number: 4,669,542

[45] Date of Patent: Jun. 2, 1987

[54] SIMULTANEOUS RECOVERY OF CRUDE FROM MULTIPLE ZONES IN A RESERVOIR

[75] Inventor: V. N. Venkatesan, Arlington, Tex.

[73] Assignee: Mobil Oil Corporation, New York, N.Y.

[21] Appl. No.: 673,628

[22] Filed: Nov. 21, 1984

[51] Int. Cl.[4] ..... E21B 43/243

[52] U.S. Cl. ..... 166/258; 166/266; 166/268; 166/269

[58] Field of Search ..... 166/256, 258, 266, 267, 166/268, 269

[56] References Cited

U.S. PATENT DOCUMENTS

| | | | |
|---|---|---|---|
| 2,584,605 | 2/1952 | Merriam et al. | 166/266 X |
| 3,174,543 | 3/1965 | Sharp | 166/256 |
| 3,580,336 | 5/1971 | Meldau | 166/256 X |
| 3,675,715 | 7/1972 | Speller, Jr. | 166/256 |
| 4,261,420 | 4/1981 | Hitzman | 166/268 X |
| 4,344,486 | 8/1982 | Parrish | 166/266 X |
| 4,552,216 | 11/1985 | Wilson | 166/261 |

*Primary Examiner*—George A. Suchfield
*Attorney, Agent, or Firm*—Alexander J. McKillop; Michael G. Gilman; Charles A. Malone

[57] ABSTRACT

A method for simultaneous recovery of crude oil from multiple zones in a reservoir is disclosed wherein multiple wells, each in fluid communication with at least two hydrocarbon zones separated by an impermeable barrier, are used to produce oil in an enhanced recovery process. The end product from recovery in one zone is used to augment the recovery process in another zone.

5 Claims, 3 Drawing Figures

SIMULTANEOUS RECOVERY OF CRUDE FROM MULTIPLE ZONES IN A RESERVOIR

BACKGROUND OF THE INVENTION

Until recently, virtually all the oil produced in the world was recovered by primary methods, which relied on natural pressures to force the oil from a petroleum reservoir. Natural pressures within a petroleum reservoir cause oil to flow through the porous rock into wells and, if the pressures are strong enough, up to the surface. However, if natural pressures are initially low or diminish with production, pumps or other means are used to lift the oil. Recovery of oil using natural pressures is called primary recovery, even when the oil has to be lifted to the surface by mechanical means.

As new fields have become increasingly difficult and more costly to find and oil prices have risen, the stimulus to increase recovery from known fields has steadily become stronger. Enhanced oil recovery research has been conducted for many years and commercial application of these procedures is becoming more and more feasible. Enhanced oil recovery processes begin with four basic tools: chemicals, water, gases and heat. Of importance are the in-situ combustion method, which uses heat as a basic tool, and miscible recovery, using carbon dioxide as a basic tool.

The in-situ combustion method produces heat energy by burning some of the oil within the reservoir rock itself. Air is injected into the reservoir and a heater is lowered into the well to ignite the oil. Ignition of the air/crude oil mixture can also be accomplished by injecting heated air or by introducing a chemical into the oil-bearing reservoir rock. The amount of oil burned and the amount of heat created during in-situ combustion can be controlled to some extent by varying the quantity of air injected into the reservoir.

The physics and chemistry of in-situ combustion are extremely complex. Basically, the combustion heat vaporizes the lighter fractions of crude oil and drives them ahead of a slowly moving combustion front created as some of the heavier unvaporized hydrocarbons are burned. Simultaneously, the heat vaporizes the water in the combustion zone. The resulting combination of gas, steam and hot water aided by the thinning of the oil due to the heat and the distillation of the light fractions driven off from the oil in the heated region moves the oil from injection to production wells.

Carbon dioxide miscible recovery may be used, although carbon dioxide may not be initially miscible with crude oil. But, when the carbon dioxide is forced into an oil reservoir, some of the smaller, lighter hydrocarbon molecules in the contacted crude will vaporize and mix with the carbon dioxide, forming a wall of enriched gas consisting of carbon dioxide and light hydrocarbons. If the temperature and pressure of the reservoir are suitable, this wall of enriched gas will mix with more of the crude forming a bank of miscible solvents capable of efficiently displacing large volumes of crude oil ahead of it. Additional carbon dioxide is injected to move the solvent back toward the producing wells.

Traditionally, carbon dioxide is found in underground deposits and can be produced through wells similar to gas wells. Normally, however, the carbon dioxide must be transported to the oil reservoir, which can add significantly to the cost of this enhanced oil recovery process.

Natural gas and air have also been used in the miscible gas injection processes to aid in the secondary recovery of oil from known reservoirs. In addition, chemicals, such as alkalis, polymers and surfactants have been used in conjunction with water flooding to aid in recovery of crude.

A problem with the methods of enhanced oil recovery presently known is that at a given reservoir, only one method of enhanced oil recovery will be used at a time.

SUMMARY OF THE INVENTION

A method for recovering crude oil from multiple reservoir zones is disclosed in the present invention. A plurality of wellbores are drilled into a single reservoir having multiple zones separated by an impermeable barrier, such as shale. Each wellbore is configured to have separate conduits for each recovery zone. One zone uses an in-situ combustion method for enhanced oil recovery. The by-products of this recovery method are processed and carbon dioxide is separated from other gases. The carbon dioxide is forced into another oil zone under pressure to pressurize the zone and produce unrecovered crude.

DESCRIPTION OF THE PREFERRED EMBODIMENT

Figure 1:
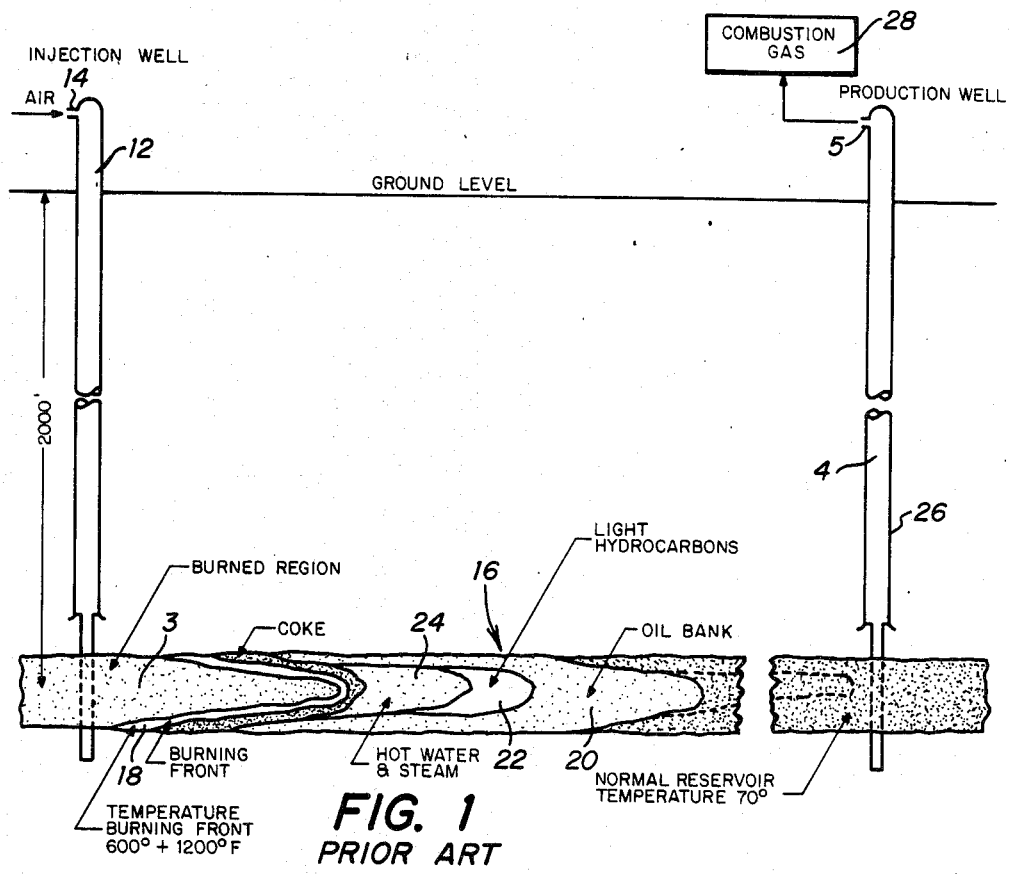
FIG. 1 PRIOR ART
FIG. 1 is an illustration of a prior art method of enhanced oil recovery.

FIG. 1 illustrates a typical arrangement for enhanced oil recovery. Although only two oil wells are shown, the illustrated method of enhanced oil recovery is suitable for use on a plurality of wells. Each of the two wells illustrated represent one of two functions, an injection well and a production well. Oil well 12 represents an injection well in which pure oxygen, enhanced oxygenated air or air is injected through opening 14 to hydrocarbon zone 16. While the oxygen-rich fluid is being injected through well 12, the residual hydrocarbons in zone 16 are ignited by methods well known in the art. This results in a burning front 18 which forces ahead an oil bank 20 with an area of light hydrocarbons 22 and an area of hot water and steam advancing towards production well 26. As oil bank 20, light hydrocarbons area 22 and hot water and steam area 24 advance towards production well 26, an area of coke is left in its wake, which is ignited by burning front 18 when combined with oxygen-enriched fluid through injection well 12. Normal reservoir temperature is approximately 70° F., while the temperature of the burning front 18 may be between 600° and 1200° F.

As a result of this in-situ combustion method, a combination of oil, water and product gases will be produced at production area 28 of production well 26.

Figure 2:
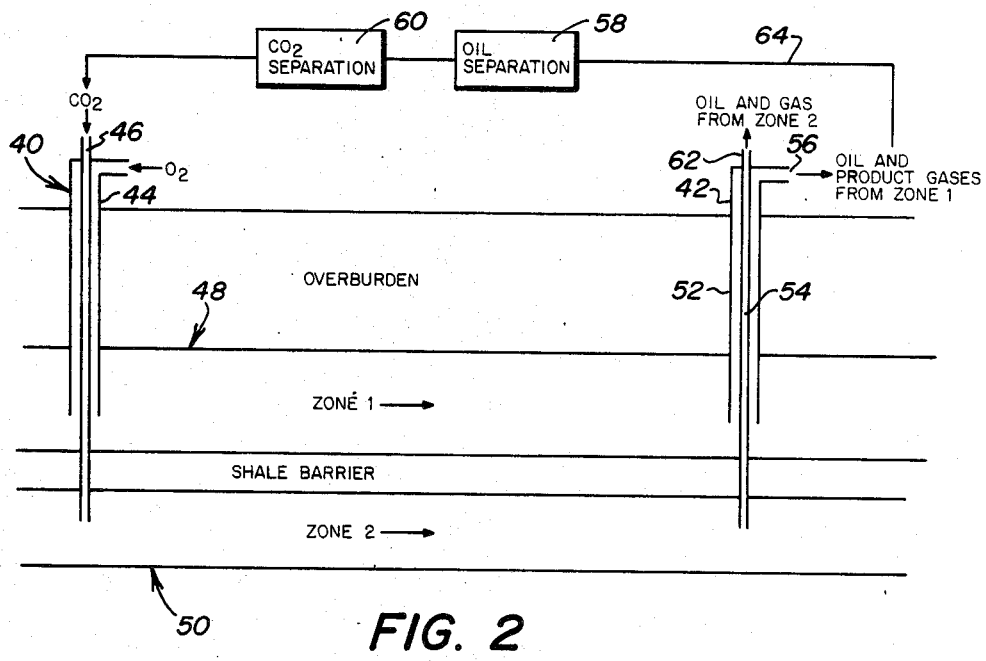
FIG. 2 is an illustration of enhanced oil recovery from two zones simultaneously.

FIG. 2 illustrates an injection well 40 and a production well 42. Injection well 40 is illustrated as having two casings 44 and 46, casing 46 being within casing 44. Casing 44 provides a fluid path from the earth's surface to hydrocarbon zone 48. Casing 46 provides a fluid path from the earth's surface to hydrocarbon zone 50.

Similarly, production well 42 is illustrated as having casings 52 and 54. Casing 54 is located within casing 52 and provides a fluid path from hydrocarbon zone 50 while casing 52 provides a fluid path between the surface and hydrocarbon zone 48. The dual casing injection well 40 and the dual casing production well 42 are both used in conjunction with two different methods of enhanced oil recovery. For purposes of discussion, an in-situ combustion method of enhanced oil recovery is used in conjunction with hydrocarbon zone 48 whereas a carbon dioxide miscible enhanced oil recovery method is used in conjunction with hydrocarbon zone 50.

Although casing to the lower hydrocarbon zone 50 is illustrated as being located within the casing to the upper hydrocarbon zone 48, casings 44 and 52 may be extended to the lower hydrocarbon zone 50, the only important aspect being that production from hydrocarbon zone 48 and hydrocarbon zone 50 be isolated within the well, such as packing blocks within the casing, or any other methods well known in the art. As explained in conjunction with FIG. 1, a production well such as production well 42 will produce oil and product gases through outer casing 52 from an in-situ combustion method. The oil and product gases from hydrocarbon zone 48 will be produced at outlet 56 and are carried to oil separator 58 through conduit 64. The resultant gases from oil separator 58 are conveyed to carbon dioxide separator 60 wherein carbon dioxide is separated and conveyed to conduit 46 of injection well 40. The carbon dioxide is injected into hydrocarbon zone 50 through casing 46 for a carbon dioxide miscible enhanced oil recovery process.

In the carbon dioxide miscible process, carbon dioxide is forced into an oil reservoir. Although carbon dioxide may not be initially miscible with crude oil, some of the smaller, lighter hydrocarbon molecules in the crude oil of hydrocarbon zone 50 will vaporize and mix with the carbon dioxide, forming a wall of enriched gas consisting of carbon dioxide and light hydrocarbons. This wall of enriched gas will mix with more of the crude forming a blank of miscible solvents capable of efficiently displacing large volumes of crude oil ahead of it. The solvent is then moved toward production well 42 by injection of additional carbon dioxide to force the solvent wall to push the crude oil to casing 54. Crude oil from hydrocarbon zone 50 is thus produced at production area 62 at the end of casing 54.

Thus, the use of one method of enhanced oil recovery in hydrocarbon zone 48 that is in-situ combustion method produces by-products, namely, carbon dioxide, which may be used to produce crude oil from hydrocarbon zone 50 from the same production well by using the carbon dioxide miscible enhanced oil recovery process.

Figure 3:
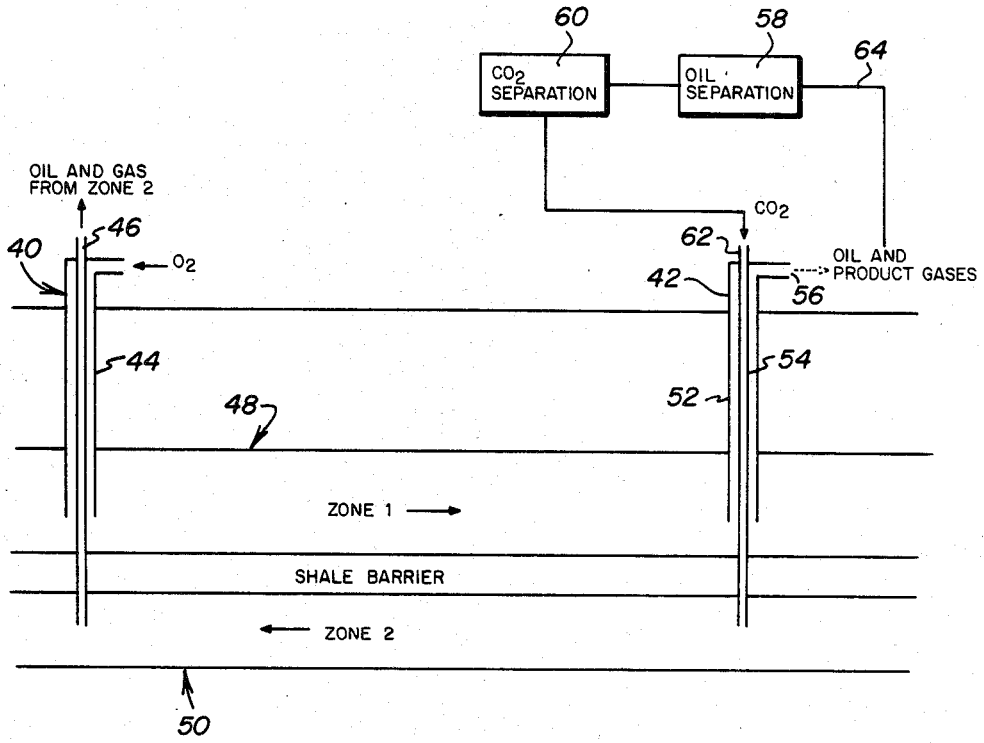
FIG. 3 is an illustration of an alternate method of enhanced oil recovery from two zones simultaneously.

FIG. 3 illustrates an alternate method of the preferred method of the present invention. In FIG. 3, the carbon dioxide from carbon dioxide separator 60 is injected down casing 54 into hydrocarbon zone 50. A carbon dioxide miscible enhanced oil recovery method is still used in hydrocarbon zone 50 with the exception that casing 46 is used as the production casing and casing 54 is used as the injection casing.

The method of the present invention for simultaneous recovery of hydrocarbons from two hydrocarbon zones may be accomplished by using both casings in a well for production or by using one casing for production and one casing for injection or alternating a casing between injection and production to maximize the crude recovered from a hydrocarbon-bearing zone.

While the present invention has been illustrated by way of preferred embodiment, it is to be understood that the present invention is not limited thereto but only by the scope of the following claims.

I claim:

1. A method for simultaneously recovering hydrocarbonaceous fluids from a formation or reservoir containing same having multiple permeability zones separated by a shaley layer comprising:

(a) injecting via a first injection means provided in a well an oxygen containing fluid into a first hydrocarbonaceous zone fluidly communicating with a first a production means provided in a well where said first zone is vertically diplaced from a second hydrocarbonaceous zone and separated by said shaley layer;

(b) combusting in-situ said first zone and producing hydrocarbonaceous fluids containing carbon dioxide therein as a conbustion by-product from said production means provided in a well;

(c) separating carbon dioxide from said hydrocarbonaceous fluids;

(d) injecting carbon dioxide into said second zone via a second injection means provided in a well which is fluidly connected to a second production means provided in a well in said second zone while simultaneously producing fluids from said first zone; and (e) producing hydrocarbonaceous fluids containing carbon dioxide from said second zone via said second production means.

2. The method as recited in claim 1 where in step (d) said second injection means is contained within the well containing said first injection means of step (a).

3. The method as recited in claim 1 where in step (d) said second production means is contained within the well containing said first production means of step (b).

4. The method as recited in claim 1 where in step (d) said second injection means is contained within the well containing the production means of step (b).

5. The method as recited in claim 1 where in step (d) said second production means is contained within the well containing the injection means of step (a).

* * * * *